United States Patent [19]

Shimizu et al.

[11] 4,115,147

[45] Sep. 19, 1978

[54] PROCESS FOR PRODUCING NUTRITIVE SUGAR FROM CANE JUICE

[75] Inventors: Junichi Shimizu, Yokohama; Kyosuke Hashizume, Chiba, both of Japan

[73] Assignee: Mitsui Sugar Co., Ltd., Tokyo, Japan

[21] Appl. No.: 779,279

[22] Filed: Mar. 18, 1977

[30] Foreign Application Priority Data

Apr. 1, 1976 [JP] Japan ..... 51-36357

[51] Int. Cl.[2] ..... C13D 3/16; C13F 3/00

[52] U.S. Cl. ..... 127/54; 127/30; 127/46 R; 210/22 R

[58] Field of Search ..... 127/54, 55, 30, 46 R; 210/22

[56] References Cited

U.S. PATENT DOCUMENTS

| | | | |
|---|---|---|---|
| 2,593,540 | 4/1952 | Cornwell | 127/54 X |
| 3,228,876 | 1/1966 | Mahon | 127/54 X |
| 3,342,729 | 9/1967 | Strand | 127/54 X |
| 3,914,410 | 10/1975 | Godfrey | 127/30 X |

OTHER PUBLICATIONS

R. F. Madsen, Intl. Sugar Jour., 75, 163–167 (1973).

*Primary Examiner*—Sidney Marantz
*Attorney, Agent, or Firm*—Kane, Dalsimer, Kane, Sullivan and Kurucz

[57] ABSTRACT

A process of producing a nutritive sugar as being non-centrifugal sugar from cane juice by treating said cane juice by ultrafiltration means, then concentrating by evaporation the permeate obtained thereby and furthermore the concentrate obtained at the same time in the said filtration step is further used for the conventional production of cane sugar.

3 Claims, No Drawings

PROCESS FOR PRODUCING NUTRITIVE SUGAR FROM CANE JUICE

BACKGROUND OF THE INVENTION

1. Field of the Invention

The present invention relates to a process for producing advantageously non-centrifugal nutritive sugar having delicious taste from cane juice.

2. Brief Description of the Prior Art

The term "cane juice" herein described corresponds to pressed juice obtained by milling sugar cane as well as diffusion juice obtained by extracting the same and so on in the cane sugar manufactory.

The cane juice said above contains starch, gummy polysaccharides, proteins, coloring matters, inorganic colloids, reducing sugars, amino acids, organic acids, vitamins (such as biotin, pantothenic acid, etc.), minerals and flavours in addition to sucrose and these impurities other than sucrose are removed in a process of the production of cane sugar from the said cane juice by means of a suitable combination of chemical purifying treatments such as purifying with lime, treatment with phosphoric acid, aggregation treatment with polyacrylamide-high molecular electrolyte, saturation with carbon dioxide as well as with sulfur dioxide, desalting with ion-exchange resin, etc. during purification and refining step in the manufacture of sugar from the said cane juice. Hitherto, raw sugar and refined sugars such as soft white sugar, yellow soft sugar, granulated sugar and so on have been produced by means of said purification and refining processes from cane juice.

On the other hand, also non-centrifugal sugar, for example KoKu-To (Brown sugar lumps, Japan), Shiroshita-To (Japan), muscovado, Jaggery and so on have been produced by boiling down in an open pan after removing of lye and scum by adding a small amount of lime to the cane juice.

Although, as stated above, there are many kinds of conventional sugar products, since refined sugars consist componentially almost of pure sucrose, according to the purpose of use thereof, there are disadvantages of lack of flavour and nutritive unbalance. Non-centrifugal sugar such as muscovado sugar and Koku-To has disadvantage of unfavorable external appearance and inferior taste originated in coloring matters and organic colloidal high molecular impurities contained therein. Thus, it has unfavorable properties such as too much colored and when dissolved a turbid solution is obtained and the produced solution has a taste of strong harshness.

SUMMARY OF THE INVENTION

In view of the aforesaid disadvantages in the conventional sugar manufacturing, we have studied for the purpose to afford a novel highclass-grade non-centrifugal sugar having delicious taste and also still containing vitamins, minerals and flavours by removing starchy substances, gummy substances, proteins, coloring matters, inorganic colloids and further high molecular weight substances such as fungus bodies of microorganisms as well as colloidal substances and we have now found that non-centrifugal sugar as said above can be obtained by treating the cane juice with ultrafiltration means, then concentrating by evaporation the obtained permeate and furthermore the concentrate simultaneously obtained can be applied for the conventional production of the sugar products and thus the present invention has been accomplished.

DETAILED DESCRIPTION OF THE INVENTION

The present invention will be further explained as set forth under.

The present invention comprises treating the cane juice with ultrafiltration means, then concentrating by evaporation the obtained permeate to yield non-centrifugal sugar and at the same time applying the concentrate for the manufacturing of cane sugar by the conventional process used for the production of cane sugar from the sugar cane juice. Also this concentrate has a distinctive feature of being capable of production of conventional sugars.

The cane juice used according to the invention is the same material as used hitherto in the production of cane sugar, however, it may be used whether it may be a pressed juice obtained by pressing sugar cane for example by means of mill or an extracted juice obtained by extracting sugar cane as being conventionary producted in the sugar manufactory.

According to the invention said cane juice is collected in a process of sugar manufacturing and is then treated with ultrafiltration means. As for said ultrafiltration means used in the invention, usually a conventional ultrafiltration means may be applied, however, as for ultrafilter-membrane, it is preferable to use in a range of molecular weight cut of from 10,000 to 30,000, because when an ultrafilter membrane of molecular weight cut of below 10,000 is used, there is a tendency of inhibiting of permeation of sucrose and accordingly the contents of sucrose in the permeate will be lowered to result in a hindrance of the production of nutritive sugar in and on the other hand when an ultrafilter-membrane of molecular weight cut of higher than 30,000 is used, coloring matters, organic colloidal substances etc. contained in the sugar cane juice are permeated through the membrane to prevent the obtaining of desired non-centrifugal sugar from the permeate. As for the type of ultrafilter-membrane to be used for the ultrafiltration means as said above, a membrane having a shape of wide varieties such as plane, tubular, spiral, hollow fibre membrane, etc. may be applied.

In the treatment of the can juice under the use of ultrafiltration means as stated above, when the average residence time of the cane juice in the ultrafiltration apparatus is reduced by lowering the frequency of recycling of the obtained concentrate, the inversion percent of sucrose in the said sugar cane juice by the action of invertase and an acidity is reduced; therefore, when it is desired utmost to reduce the inversion of cane sugar, it is preferable to control the average residence time as shorter as possible. Since vitamins, minerals and flavours are contained in addition to sucrose in the permeate obtained by the treatment of the cane juice with ultrafiltration means, when this is concentrated by evaporation, there can be obtained a non-centrifugal sugar of very delicious taste. With respect to the permeate, it is preferable not to apply any chemical purifying treatment as stated above.

To concentrate by evaporation the said permeate a conventional concentration apparatus may be applied such as multiple effect evaporator, single vacuum evaporator, open pan and so on.

Although concentrated permeate per se may be applied for food as high grade non-centrifugal nutritive sugar, it may be also applied as crystal-containing form by crystallizing thereof.

Components of the nutritive sugar thus obtained are shown in the following table.

| Component | Content based on solid |
|---|---|
| Sucrose | 87.8% |
| Reducing sugar | 4.4% |
| Minerals | 1.5% |
| Vitamins | |
| Vitamin $B_1$ | 1.38 ppm |
| Vitamin $B_2$ | 0.42 ppm |
| Vitamin $B_6$ | 0.48 ppm |
| Inositol | 167 ppm |
| Pantothenic acid | 5.8 ppm |
| Nicotinic acid | 1.67 ppm |
| Biotin | 0.14 ppm |
| Organic acids | |
| Aconitic acid | 1.26% |
| Malic acid | 0.25% |
| Amino acids | |
| Alanine | 0.092% |
| Aspartic acid | 0.306% |
| Valine | 0.047% |
| Color value (Stammer) | 14.8 |

On the other hand the concentrated liquid obtained by the treatment of said ultrafiltration means is utilized for the production of cane sugar applying the conventional process as used in the process for untreated cane juice.

According to the invention, as stated above, it is possible to produce advantageous a nutritive sugar having very delicious taste from the cane juice used as material in the process of the production of cane sugar without causing any disadvantage in the production of cane sugar; therefore, it may be said that the present invention will greatly contribute to the cane sugar manufacturing industry.

The present invention will be further illustrated by the following examples.

EXAMPLE 1

Fifty kilograms of cane juice obtained by passing first expressed juice of cane sugar manufacturing factory through a 50 mesh strainer to remove baggacillo is permeated through a tubular type module (ϕ ½", filter area 0.45 m²) equipped with an ultra-filter membrance (Volume Displacement Rod (VDR) #220, molecular weight cut 15,000; Product of Universal Oil Products (U.O.P.) ) at a flow rate of 8l/min. and pressure of 10 kg./cm² G under recycling of 50 minutes to provide 6.71 kg. of permeate and 42.96 kg. of concentrate. Assays of the sugar cane juice supplied to ultrafiltration apparatus and permeate as well as concentrate obtained by ultrafiltration are shown in Table I.

TABLE I

| | Supplied juice | Permeate | Concentrate | Note |
|---|---|---|---|---|
| Brix Degree (Bx) | 18.12 | 16.87 | 18.18 | Apparent solid |

TABLE I-continued

| | Supplied juice | Permeate | Concentrate | Note |
|---|---|---|---|---|
| Polarization | 15.47 | 14.59 | 15.51 | Measured by polarimeter |
| Apparent Purity (%) | 85.37 | 86.48 | 85.32 | $\frac{\text{Polarization}}{\text{Brix}} \times 100$ |
| Reducing Sugar (%) | 0.69 | 0.72 | 0.71 | Inversion ratio 2.32 % |
| Total Sugar (%) as Reducing Sugar | 17.19 | 16.31 | 17.26 | |
| pH | 5.6 | 5.65 | 5.6 | |
| Color Value | 266 | 11.8 | 306 | Stammer |

The permeate obtained as above is evaporated in a vacuum to Bx 60°, then in an open pan and the residue obtained is quenched and stirred to provide 1.20 kg. of solid high grade non-centrifugal sugar (nutritive sugar). While the concentrate is brought back to the said cane juice being removed baggacillo therefrom and is utilized for the production of raw sugar. Inversion ratio in Table II is calculated according to the following formula.

$$\frac{\text{Total weight of reducing sugar in permeate and concentrate} - \text{Weight of reducing sugar in the juice supplied}}{\text{Weight of reducing sugar in the juice supplied}} \times 100\ (\%)$$

EXAMPLE 2

Forty three kg. of cane juice obtained as in Example 1 is permeated through a tubular module equipped with ultrafilter membrane of molecular weight cut of 10,000 manufactured by U.O.P. under recycling of 75 minutes at the pressure of 15 kg./cm². Size of the module and the flow rate of the liquid to be treated are the same with these of Example 1. Thus 7.00 kg. of permeate and 35.9 kg. of concentrate are obtained. Assays of the obtained supplies, permeates and concentrates are shown in Table II.

TABLE II

| | Supplied juice | Permeate | Concentrate | Note |
|---|---|---|---|---|
| Brix Degree (Bx) | 17.12 | 12.61 | 18.05 | |
| Polarization | 14.12 | 10.29 | 14.09 | |
| Apparent Purity (%) | 82.48 | 81.60 | 82.55 | |
| Reducing Sugar (%) | 0.89 | 0.85 | 0.94 | Inversion percent 3.74 % |
| Total Sugar (%) as Reducing Sugar | 16.03 | 11.95 | 16.92 | |
| pH | 5.4 | 5.5 | 5.4 | |
| Color Value | 206 | 5.27 | 242 | Stammer |

The permeate obtained as above is evaporated in a vacuum to Bx 60°, then in an open pan and the residue obtained is quenched and stirred quickly to provide 0.95 kg. of solid non-centrifugal sugar (nutritive sugar). On the other hand the concentrate is purified with lime and then repeated the treatments of concentrating in a vacuum and then crystallization and thus 5.4 kg. of raw sugar are obtained.

EXAMPLE 3

46.66 kg. of cane juice obtained by collecting a mixed juice in the cane sugar manufacturing factory, then removing baggacillo by means of 50 mesh strainer is permeated through a tubular type module as described in Example 1 at a supplying rate of 7l/min at 10 kg./cm$^2$G under recycling of 60 minutes and 91.6 kg. of permeate and 37.36 kg. of concentrate are obtained assays thereof are shown in Table III.

TABLE III

| | Supplied juice | Permeate | Concentrate | Note |
|---|---|---|---|---|
| Brix Degree (Bx) | 13.56 | 13.12 | 13.73 | |
| Polarization | 11.19 | 10.86 | 11.32 | |
| Apparent Purity (%) | 82.52 | 82.77 | 82.46 | |
| Reducing Sugar (%) | 0.67 | 0.70 | 0.69 | Inversion percent 2.94 % |
| Total Sugar (%) as Reducing Sugar | 12.66 | 12.35 | 12.79 | |
| pH | 5.2 | 5.0 | 5.0 | |
| Color Value | 280 | 15.2 | 348 | |

On the other hand, the concentrate is purified with lime according to the conventional method, concentrated to about 68° Bx under a reduced pressure and after boiling down in an open pan it is crystallized in a high speed mixer to provide about 5.4 kg. of Koku-To (Brown sugar lump, Japan).

EXAMPLE 4

24.20 kg. of mixed juice as collected in Example 3 are treated with a tubular type module for 10 minutes. Then, 1.53 kg. of permeate and 22.60 kg. of concentrate are obtained. Assays of the supplied juice, permeate and concentrate are shown in Table IV.

TABLE IV

| | Supplied juice | Permeate | Concentrate | Note |
|---|---|---|---|---|
| Brix Degree (Bx) | 13.84 | 13.40 | 13.86 | |
| Polarization | 11.43 | 11.11 | 11.44 | |
| Apparent Purity (%) | 82.59 | 82.91 | 82.54 | |
| Reducing Sugar. (%) | 0.60 | 0.64 | 0.60 | Inversion percent 0 % |
| Total Sugar (%) as Reducing Sugar | 12.82 | 11.94 | 12.83 | |
| pH | 5.3 | 5.3 | 5.3 | |
| Color Value | 210 | 14.2 | 228 | Stammer |

As shown in Table IV, when the treating time by the ultrafiltration means is short, inversion of cane juice does not occur.

Articles in Tables II–IV are the same with these of Table I.

We claim:

1. A process for producing nutritive sugar from cane juice which comprises treating said cane juice with an ultrafiltration means, concentrating by evaporation the obtained permeate to provide nutritive sugar as being non-centrifugal sugar and also utilizing concentrate obtained simultaneously at the same filtration treatment for the production of cane sugar according to a conventional process for producing cane sugar.

2. The process for producing nutritive sugar as claimed in claim 1, wherein ultrafiltration apparatus is equipped with an ultrafilter-membrane in a range of molecular weight cut of from 10,000 to 30,000.

3. A process for producing a nutritive brown sugar from cane juice, which comprises; processing the juice through an ultrafiltration means; and evaporating the permeate to obtain a non-centrifugal, nutritive brown sugar.

* * * * *